United States Patent [19]

DeNigris et al.

[11] 4,052,688

[45] Oct. 4, 1977

[54] FUSE CLIP ASSEMBLY

[75] Inventors: Ernest Gerard DeNigris, Colts Neck; Albert John Tutko, Belle Mead, both of N.J.

[73] Assignees: Bell Telephone Laboratories, Incorporated, Murray Hill, N.J.; Western Electric Company, Incorporated, New York, N.Y.

[21] Appl. No.: 726,966

[22] Filed: Sept. 27, 1976

[51] Int. Cl.[2] ..... H01H 85/20

[52] U.S. Cl. ..... 337/213; 337/187; 339/258 F

[58] Field of Search ..... 337/213, 214, 186, 187, 337/188, 190, 194, 208, 228, 229, 236, 244; 339/258 F, 259 F, 262 F

[56] References Cited

U.S. PATENT DOCUMENTS

| | | | |
|---|---|---|---|
| 1,172,282 | 2/1916 | Handley et al. | 337/213 |
| 2,271,693 | 3/1942 | House | 337/186 |
| 2,308,596 | 1/1943 | Drury | 337/187 |
| 2,958,020 | 10/1960 | Eannarino | 339/258 F |
| 3,218,413 | 11/1965 | Koch | 337/213 |
| 3,450,949 | 6/1969 | Inglis | 337/244 |

*Primary Examiner*—Harold Broome
*Attorney, Agent, or Firm*—David H. Tannenbaum

[57] ABSTRACT

A fuse clip assembly is disclosed for use with alarm type fuses. The assembly includes a forward spring tension clip, a rear spring tension clip and an alarm terminal. The rear clip is shaped to thrust the fuse forward while the forward clip is designed with a shoulder to position the fuse. The alarm terminal is positioned to catch an extended fuse alarm terminal and is shaped to securely capture the terminal to insure positive electrical contact for alarm purposes. An arrangement is disclosed which provides visual-only alarm indications.

11 Claims, 5 Drawing Figures

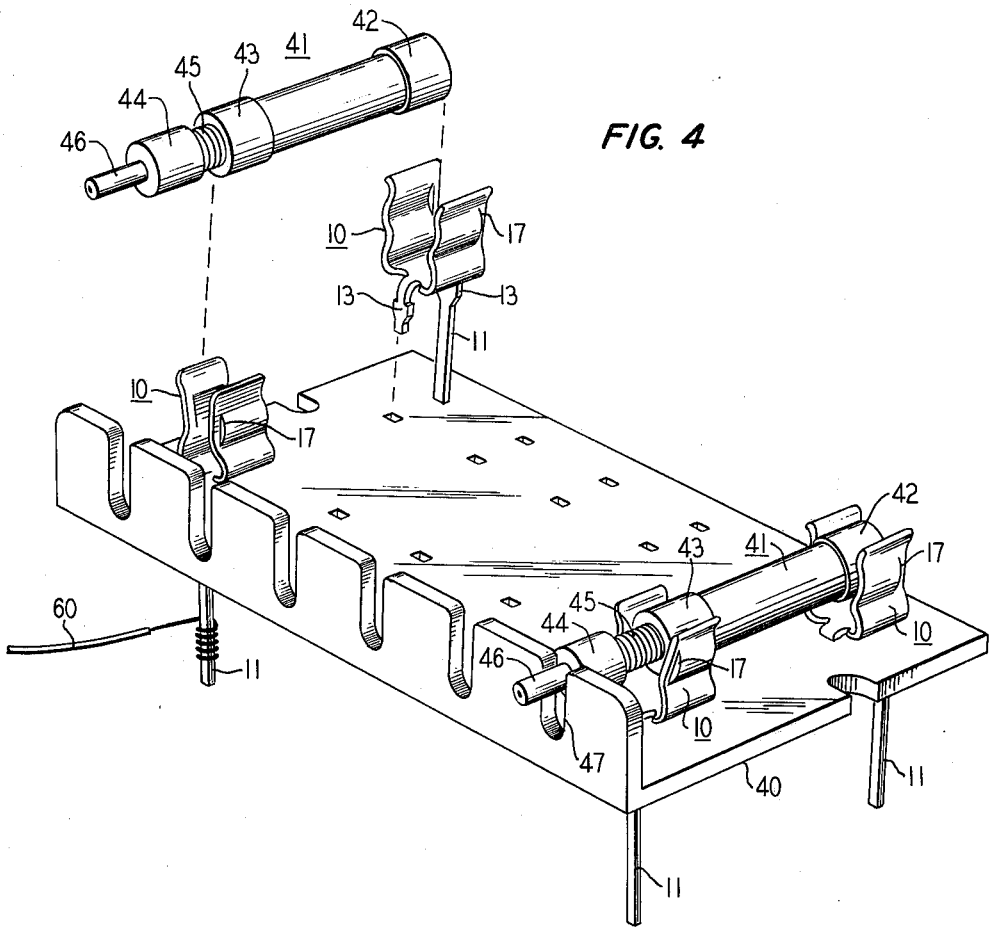
FIG. 4
FIG. 5
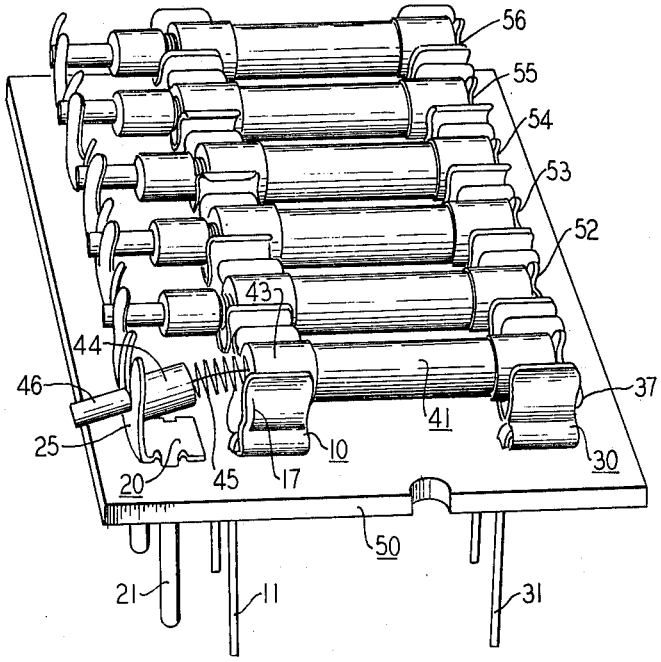

FUSE CLIP ASSEMBLY

FIELD OF THE INVENTION

This invention relates to a spring tension fuse clip assembly for making mechanical and electrical contact with an inserted tubular type alarm fuse.

BACKGROUND OF THE INVENTION

Fuse clips and fuse clip assemblies are well known in the art. In the typical fuse clip assembly there is a forward clip for making mechanical and electrical contact with one terminal of the fuse and a second clip, spaced apart from the forward clip, for making electrical and mechanical contact with a second terminal of the fuse. This arrangement serves well for two terminal fuses where electrical current passes through the fuse only while the fuse element is whole or unblown. When the element of such a fuse is overloaded its element opens and the passage of electrical current is stopped.

There is another type of tubular fuse, known as the alarm fuse, which provides a third terminal for making electrical contact with an alarm circuit when the fuse element opens. Thus, additional restraints must be placed on any fuse clip assembly designed to accept such an alarm fuse. These restraints arise from the fact that the fuse body must be held in a fixed position relative to the alarm terminal of the assembly in order to insure proper electrical contact when the fuse is blown. Also, the alarm terminal of the fuse must contact the alarm terminal of the fuse assembly with a force sufficient enough to break through any layer of dirt or oxide that might be on the terminal and with a force sufficient to maintain electrical contact for alarm purposes.

Accordingly, it is an object of our invention to design a fuse clip assembly having three terminals and designed to accept alarm type fuses and to maintain the fuse in a closely controlled mechanical position relative to the alarm terminal.

It is a further object of our invention to design such a fuse clip assembly in a manner which allows the alarm terminal of the fuse to make and hold contact with the assembly alarm terminal when the fuse element has opened.

SUMMARY OF THE INVENTION

We have arranged out fuse clip assembly with three terminals spaced in a line along the axis of the inserted fuse. The terminals are called the alarm terminal, the load terminal and the line terminal. Power to the fuse is supplied via the line terminal which connects to the fuse at the front end of the fuse body. The load terminal connects to the fuse at the rear end of the fuse and is designed to apply forward pressure to the fuse body along the longitudinal axis of the fuse. The line terminal is designed to prevent the fuse from being pushed too far forward by the forward pressure of the load terminal. The alarm terminal of the assembly is shaped to accept the alarm terminal of the fuse only when the fuse is blown and to maintain electrical contact therewith.

The alarm terminal is mounted forward of the line terminal a distance such that electrical contact is not made with the fuse alarm terminal while the fuse remains unblown. The pressure exerted by the load terminal on the fuse body toward the alarm terminal serves to insure that proper electrical contact is made between the alarm terminal of the blown fuse and the fuse clip alarm terminal. The assembly alarm terminal is shaped in a manner to capture the extended fuse alarm terminal and to allow for variations in the pressures applied by the fuse alarm terminal.

Thus, it is one feature of our invention to provide a fuse clip assembly arranged to accept alarm type tubular fuses having a terminal for applying forward pressure on the fuse and a terminal for capturing an extended alarm terminal.

It is a further feature of our invention that a spring clip fuse assembly is designed to maintain a fixed positional relationship between the fuse and the alarm terminal of the assembly.

It is a still further feature of out invention that a spring clip fuse assembly is designed to provide visual-only indications for tubular type alarm fuses.

BRIEF DESCRIPTION OF THE DRAWING

These and other objects and features of our invention will be more fully appreciated from a review of the drawing in which:

FIG. 4 shows an alarm assembly for use when only visual alarms are necessary; and FIG. 5 shows an alarm assembly for use when both visual and electrical alarms are required.

DETAILED DESCRIPTION

Figure 1:
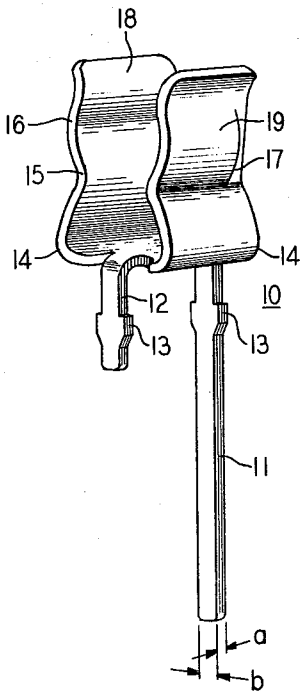
FIG. 1 shows a line terminal.

As shown in FIG. 1 the fuse clip is bent in the form of a U with the sides 18 and 19 of the U formed to accept a tubular type fuse, such as the type of fuse 41 shown in FIG. 4. The fuse clip side portions 18 and 19 of the U are formed inward at points 15 and 16 to create an outwardly curved section therebetween to accept the inserted fuse. The sides of the clips at positions 15 and 16 supply inward pressure on the electrical terminals 43 and 42 of an inserted fuse to hold the fuse in position and for proper electrical contact. This inward pressure is created by the bending of the clip at points 14. In order to control the amount of the inward pressure, and thus control the insertion and extraction forces of the fuse, points 14 and coined so as to remove some material from the cross section of the clip. In this manner a unitary piece of material can be used both for the clip and for wire wrap leg 11, so that the wire wrap leg will meet the physical dimensions for proper electrical contact to the wire which is wrapped around the leg in the manner shown in FIG. 4.

Fuse clip 10 is shown having locking tab 13 constructed along wire wrap leg 11 so that when the wire wrap leg is inserted through a hole in a mounting board, as shown in FIG. 5, the clip locks in place. Short leg 12, with locking tab 13, is used to provide mechanical stability for mounting purposes.

Slots 17 in side portions 18 and 19 form an inward detent and serve to hold an inserted fuse in position and to prevent the fuse from moving longitudinally backward or forward. This aspect will be discussed in more detail hereinafter. The manner of constructing such a fuse clip is set out in our concurrently filed conpending application, Ser. No. 726,965, which application is incorporated herein by reference.

Figure 2:
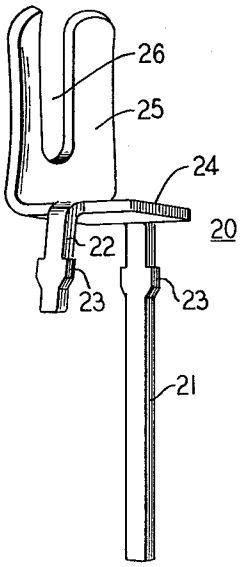
FIG. 2 shows an alarm terminal.

As shown in FIG. 2 the alarm terminal also has two legs 21 and 22 each with locking tabs 23. Leg 21 is the wire wrap leg while leg 22 is used for positional support. The upper portion of the alarm terminal is shaped with an inward or concave curve so that when an alarm terminal is thrust thereagainst the alarm terminal will remain within the area defined by the side portions 25 and 26. The top of the terminal is curved slightly inward to prevent a captured fuse alarm terminal from moving upward.

Figure 3:
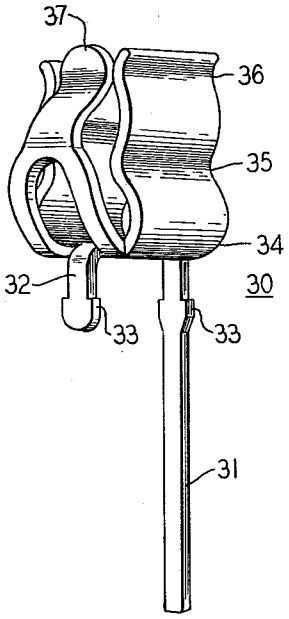
FIG. 3 shows a load terminal.

As shown in FIG. 3, the load terminal is designed similar to the line terminal of FIG. 1 except that a forward thrust spring 37 is added to apply forward pressure on an inserted fuse.

As shown in FIG. 4, fuse 41 has a rear electrical contact 42, a forward electrical contact 43, and an alarm electrical contact 44. While the fuse remains unblown spring 45 remains compressed and the forward edge of contact 44 remains about three-tenths of an inch from the leading edge of terminal 43. When the fuse element is blown the alarm terminal becomes free to move along the longitudinal axis and spring 45 causes alarm contact 44 to become extended at least 2/10 of an inch further.

Mounting board 40 is provided when only a visual indication is desired of the status of the fuse. This visual indication is available since the fuse carries visual indicator 46 which also moves forward when the fuse is blown. Thus, when the fuse assembly is arranged as shown in FIG. 4 with a pair of fuse clips inserted in the appropriate holes of board 40 visual indicator 46 would not be visible through slot 47. However, when the fuse becomes blown, visual indicator 44 moves forward and passes through slot 47.

Two fuse clips are used to hold each fuse and are mounted on board 40 along the longitudinal axis of the fuse in a position relative to each other such that one fuse clip contacts electrical terminal 43 of the fuse, while the other of the pair of fuse clips contacts electrical terminal 42 of the same fuse. Slot 17 in the forward fuse clip prevents the inserted fuse from moving forward, while slot 17 in the rearmost fuse clip prevents the inserted fuse from moving backward. Note that both of these fuse clips are identical to each other, but that the rearmost clip is mounted on the board in a reverse manner from the forwardmost clip so that slots 17 may be properly located with respect to the inserted fuse.

Turning now to FIG. 5 an assembly is shown having fuses inserted at positions 51, 52, 53, 54, 55, and 56. The fuse at position 51 is shown in the blown condition while the other fuses are shown in the unblown condition. Terminal 30 is shown applying forward pressure on the inserted fuse while at the same time making electrical contact therewith. As discussed, terminal 30 is a load terminal. Terminal 10 is shown making contact with fuse terminal 43 and slot 17 prevents the fuse from moving forward toward alarm terminal 20. Thus, electrical contact with leg 11 of clip 10 and the application of electrical current thereto will result in the flowing of electrical current to the apparatus to be protected via leg 31 of clip 30, assuming the unblown condition of the inserted fuse. Under such a condition, alarm contact 44 does not make electrical contact with alarm terminal 20. When an overload occurs the fuse element opens electrically isolating leg 31 from leg 11. At such a time fuse alarm contact 44 becomes extended under pressure from spring 45 and makes electrical contact with alarm terminal 20 thereby completing an electrical connection to the alarm circuit. Because of the shape of the alarm terminal, fuse alarm contacat 44 is forced downward and is captured within the concave section of clip 20 thereby insuring proper electrical contact. Since the fuse is being restrained from moving rearward by the operation of spring 37 of clip 30, the force applied by spring 45 is sufficient to allow for proper electrical contact even in the presence of oxidation or dirt.

What is claimed is:

1. A fuse clip mounting board assembly for use with tubular alarm type fuses, said mounting board assembly having a load spring clip terminal, a line spring clip terminal, and an alarm terminal, said load spring clip terminal including means for applying spring tension to a rear terminal of an inserted fuse, said spring tension being applied both perpendicularly to the body of said fuse and longitudinally along the axis of said fuse body, said line spring clip terminal including means for applying spring tension to a front terminal of an inserted fuse, said spring tension being applied perpendicularly to the body of said fuse, said line spring clip terminal also including means for restricting the movement of said inserted fuse forward along said longitudinal axis, and said alarm terminal including means for retaining an alarm contact extended axially from a front end of said fuse.

2. The invention set forth in claim 1 wherein said alarm terminal retaining means includes a slot for capturing a visual indicator carried in front of said fuse alarm contact.

3. The invention set forth in claim 3 wherein said alarm terminal retaining means further includes forming the areas around said slot in a concave manner with respect to a captured fuse alarm contact.

4. The invention set forth in claim 3 wherein said load spring clip terminal, said line spring clip terminal and said alarm terminal are each of unitary construction.

5. The invention set forth in claim 4 wherein said load spring clip terminal, said line spring clip terminal and said alarm terminal each include a wire wrap leg.

6. The invention set forth in claim 5 wherein each said wire wrap leg further includes a locking tab for retaining the associated terminal against a mounting board.

7. A fuse clip assembly comprising a mounting board having holes therein, first and second terminals, each having a wire wrap leg portion and a tubular fuse terminal clip portion for mating with tubular alarm type fuses, said mounting board having an edge thereof formed perpendicular to the plane of said board, said edge having shaped therein a slot, means, including the mating of said mounting board holes and locking tabs constructed on said wire wrap legs of said first and said second terminals, for securing said first and said second terminals in a line with said slot in a manner such that when a tubular alarm fuse is inserted in said first and said second terminals the visual alarm indicator located on the longitudinal axis of said fuse protrudes through said mounting board slot only when said visual alarm indicator is extended to the alarm position.

8. The invention set forth in claim 7 wherein said first and said second terminals include indents for restraining the longitudinal movement of an inserted fuse.

9. A fuse clip assembly comprising a mounting board having holes therein, first and second terminals, each having a wire wrap leg portion and a tubular fuse terminal clip portion for mating with tubular alarm type fuses, said terminals each being of unitary construction, an alarm terminal having a wire leg portion and a fuse alarm contact capture portion, p1 means, including the mating of said mounting board holes and locking tabs constructed on said wire wrap legs of said first, second and alarm terminals, for securing said first, second and alarm terminals in a line such that when a tubular alarm fuse is inserted in said first and said second terminals the fuse alarm contact located on the longitudinal axis of said fuse contacts said alarm terminal only when said fuse alarm contact is extended to the alarm position.

10. The invention set forth in claim 9 wherein said first terminal is positioned closer to said alarm terminal than is said second terminal, said first terminal including an indent for restraining the movement of an inserted fuse longitudinally toward said alarm terminal, and said second terminal including a spring for urging an inserted fuse longitudinally toward said first terminal.

11. The invention set forth in claim 10 wherein said alarm terminal has a slot therein for receiving the visual alarm indicator located on the leading edge of said fuse alarm contact and wherein said fuse alarm contact capture portion of said alarm terminal is constructed with a concave shape relative to an inserted fuse.

* * * * *